US006918325B2

(12) United States Patent
Chan

(10) Patent No.: US 6,918,325 B2
(45) Date of Patent: Jul. 19, 2005

(54) ELECTRIC WRENCH FOR VEHICLE REPAIRING

(75) Inventor: In Fong Chan, Hong Kong (HK)

(73) Assignee: Wing Wide (HK) Limited, Hong Kong (CN)

( * ) Notice: Subject to any disclaimer, the term of this patent is extended or adjusted under 35 U.S.C. 154(b) by 51 days.

(21) Appl. No.: 10/645,966

(22) Filed: Aug. 19, 2003

(65) Prior Publication Data

US 2004/0149470 A1 Aug. 5, 2004

(30) Foreign Application Priority Data

Feb. 5, 2003 (HK) ..... 03100818

(51) Int. Cl.[7] ..... B25B 21/00
(52) U.S. Cl. ..... 81/466; 173/93.5; 173/109
(58) Field of Search ..... 81/464, 465, 466; 173/93.5, 104, 109, 117

(56) References Cited

U.S. PATENT DOCUMENTS 3,090,450 A * 5/1963 Fulop ..... 173/109
3,157,074 A * 11/1964 Durkee ..... 81/466
3,559,269 A * 2/1971 Schmitt et al. ..... 173/117
4,561,331 A * 12/1985 Pratt, Sr. ..... 81/464
5,735,354 A * 4/1998 Weidner et al. ..... 173/93.5

* cited by examiner

*Primary Examiner*—James G. Smith

(57) ABSTRACT

The present invention relates to an electric wrench for vehicle repairing which comprises a DC driving motor, transmission gears, a clutch, a power accumulator and a transmission shaft. When the DC driving motor rotates, it will drive the transmission gears which will in turn drive the power accumulator to rotate with high speed. The power accumulator will drive the clutch to rotate. When the power accumulator reaches the pre-set high speed, it accumulates sufficient inertial force. Owing to centrifugal force, the clutch will make a hammer block to impact a hammer inside the power accumulator, thus driving the transmission shaft to rotate suddenly. The electric wrench is with simple structure and can generate high output torque without producing reaction torque and angular force.

4 Claims, 4 Drawing Sheets

ELECTRIC WRENCH FOR VEHICLE REPAIRING

BACKGROUND OF THE INVENTION

The present invention relates to an electric wrench for vehicle repair and more particularly pertains to an electric wrench carried along in a motor vehicle using power supply from the motor vehicle for changing tires by loosening and tightening the bolts and nuts that fasten the wheels of the motor vehicle or of other motor vehicles.

It is not uncommon for a driver to replace a flat tire urgently on a highway or at place where there is not a car repair shop nearby or when it is not possible to call for emergency car repair service. For a long time, manual wrenches have been used to loosen and tighten the bolts and nuts so as to replace flat tires, and it is time consuming and laborious. There are now power wrenches existing in the marketplace for ease of tire replacement. However, some existing power wrenches use compressed air and so their structure is complicated and their manufacturing cost is high. Some other existing wrenches are with simplified structure but the output torque is not high enough and reaction torque and angular force commonly arise.

BRIEF SUMMARY OF THE INVENTION

In view of the aforesaid disadvantages now present in the prior art, the present invention provides an improved power wrench for vehicle repair equipped with a power accumulator controlled by a clutch, which is with simple structure and can generate high output torque without producing reaction torque and angular force.

To attain this, the present invention generally comprises a DC driving motor, one end of which is connected to the power source with power supply from a motor vehicle's battery, the other end of which is fixed onto a motor bracket by at least one screw with a slot on the motor bracket above the center axis for placing one end of a transmission shaft, and the center of which is connected to a motor gear through the motor bracket; transmission gears having a wheel gear with a hole in the center for the transmission shaft to go through and with the motor gear inside it below the hole and the gear teeth of the motor gear and the wheel gear meshing with one another; a clutch having a hole in the center for the transmission shaft to go through and having a clutch bracket with at least one hole for fixing the clutch to the wheel gear by a set pin going through it and with two balancing weights fixed onto two of its opposite sides by rivets, two small rotating shafts which are parallel to the two balance weights and fixed onto the clutch bracket by screws, two coil springs which are perpendicular to and connected to the two small rotating shafts with friction reducing washers in between, a controlling bracket sliding along the inner surface of the clutch bracket, and a collar for keeping the controlling bracket in position inside the clutch bracket; a power accumulator with a hallow in the center for the transmission shaft to go through and having a base block and a cover block fixed together by at least one screw to form a hallow inside, and one end of the base block being fixed inside the center of the clutch through the collar and connected to the wheel gear with the clutch bracket in between by the one or more set pin, and the other end of the base block facing the inner surface of the cover block having at least two holes for allowing cylindrical pins to move inside and a hammer with an impact surface facing the inner surface of the cover block above the center fixed by a screw; and a transmission shaft with one end of which fixed onto the motor bracket with a fiction reducing bearing surrounding it, and going through the center of the wheel gear with a fiction reducing bearing surrounding it and being above and parallel to the axis of the motor gear, and further going through the center of the clutch bracket and then the center of the base block with at least two ball bearings and an outer ring supporting it at the opening of the base block facing the cover block for fiction reduction, and forming a square block in the hallow formed by the base block and the cover block with a hammer block on one of its side corresponding to the hammer on the base block, and with at least two cylindrical pins going through the holes of the base block protruding with one end of the cylindrical pins pressing against the collar and the other end pressing against the side of the hammer block facing the base block, and with a spring surrounding the transmission shaft in between the hammer block and the opening of the cover block with a cap near the opening fixing the position of the spring, and with at least two ball bearings and an outer ring supporting it at the opening of the cover block for fiction reduction, and the front part of the transmission shaft protruding from the opening of the cover block with a washer in between and a bearing surrounding it for fiction reduction, and with a rubber washer at the front end of the transmission shaft for fitting onto a positioning tube for adapting to drive a nut or bolt.

The hammer and the hammer block are each in the shape of a section of a ring being one-sixth of the ring and each corresponds to the other so as to generate the greatest output torque.

The impact surface between the hammer and the hammer block is at an oblique angle in the range of 5° to 15° to facilitate ease of engagement and disengagement.

When a user turns on the electric wrench by selecting either positive current or negative current, the DC driving motor will rotate clockwise or anti-clockwise depending on whether it is positive current or negative current. When the DC driving motor rotates, it will drive the motor gear and thus drive the wheel gear to rotate. The wheel gear will accelerate and will drive the power accumulator to rotate with high speed. The power accumulator will drive the clutch to rotate. Not until the power accumulator reaches a pre-set high speed, the transmission shaft with the hammer block will not rotate. When the power accumulator reaches the pre-set high speed, it accumulates sufficient inertial force. Owing to centrifugal force, the collar automatically moves towards the clutch bracket, thereby the spring automatically moves the hammer block towards the direction of the clutch bracket. As a result, the hammer block suddenly couples with the hammer and drives the transmission shaft to rotate suddenly. A high output torque is generated to loosen and tighten the bolts and nuts quickly and easily. As the impact of the hammer block and the hammer works in a state of centrifugation, there is no torque reaction or angular force while generating high output torque.

It is an object of the present invention is to provide an improved power wrench for vehicle repair, which is of simple construction and can generate high output torque.

It is another object of the present invention is to provide an improved wrench which can generate high output torque without producing reaction torque and angular force, thus overcoming the disadvantages of the prior art.

It is a further object of the present invention is to provide a power wrench which is susceptible of a low cost of manufacture with regard to both materials and labor, and which accordingly is then susceptible of low prices of sale to the consuming public.

DETAILED DESCRIPTION OF THE INVENTION

Figure 1:
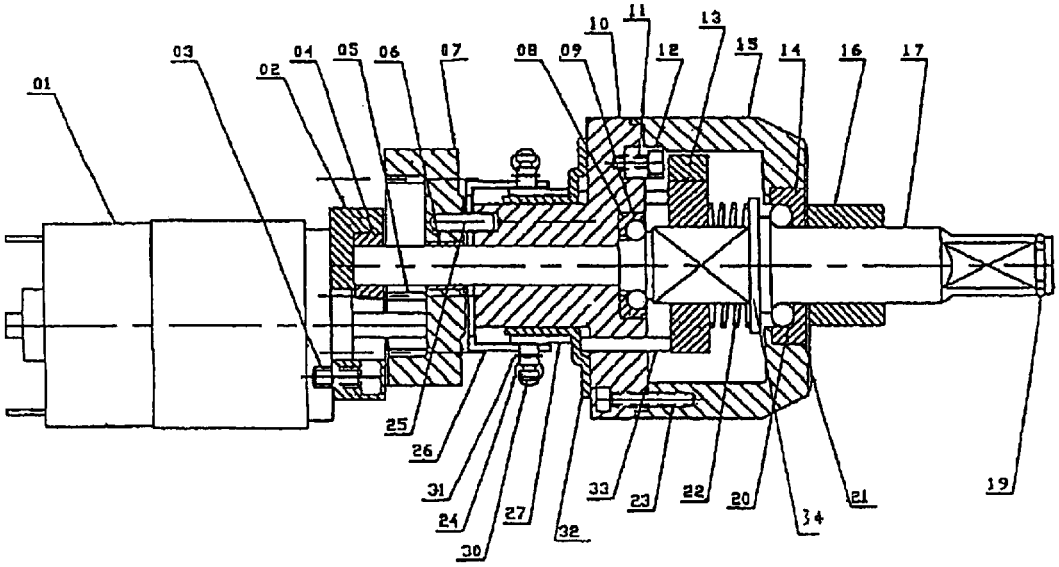
FIG. 1 is a cross-sectional view of an electric wrench of this invention.
Figure 2:
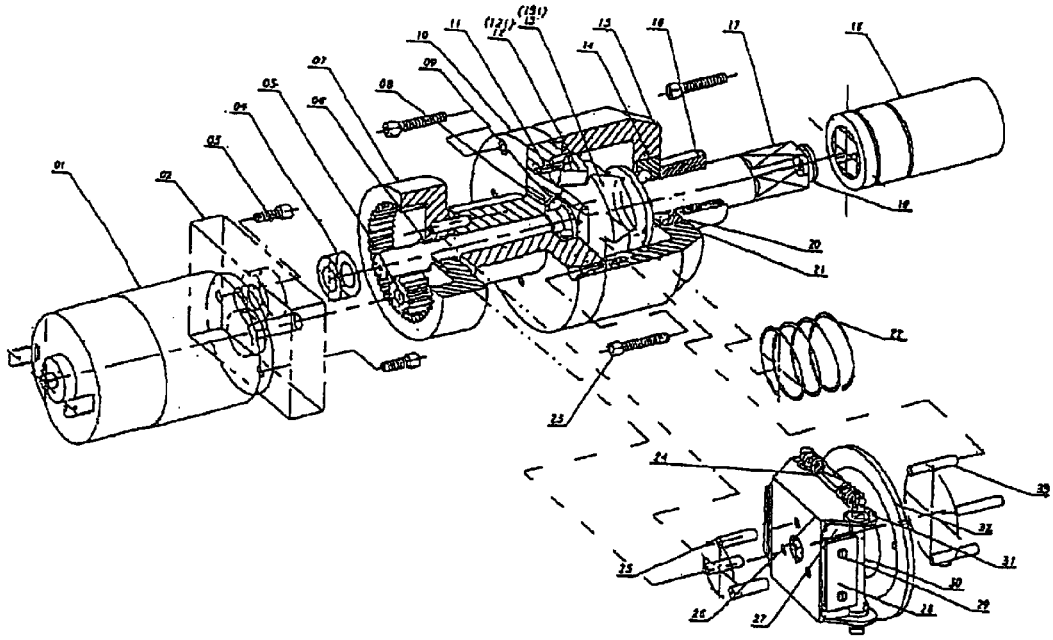
FIG. 2 is a three dimensional exploded view of the electric wrench of this invention.
Figure 3A:
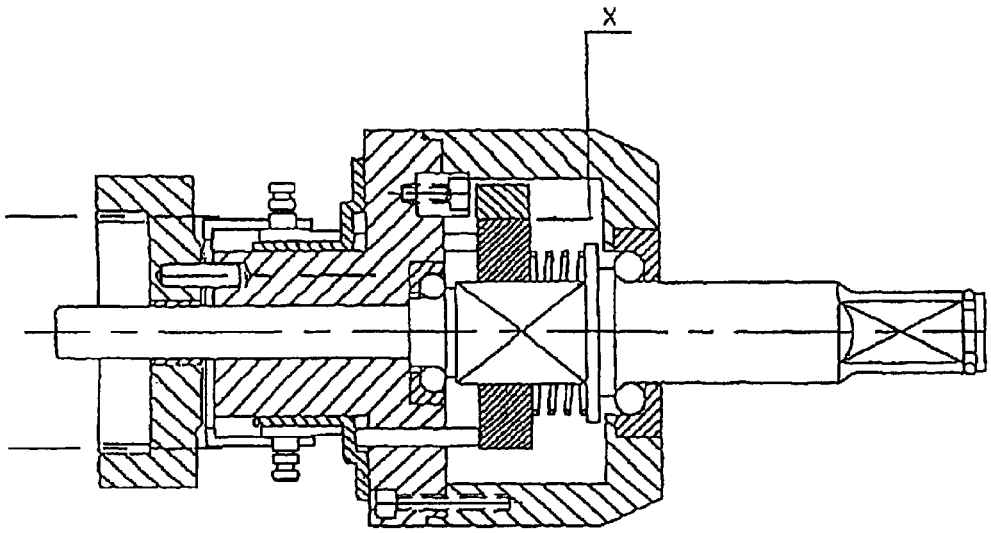
FIG. 3(A) is a cross-sectional view of the electric wrench of this invention when the hammer does not couple with the hammer block.
Figure 3B:
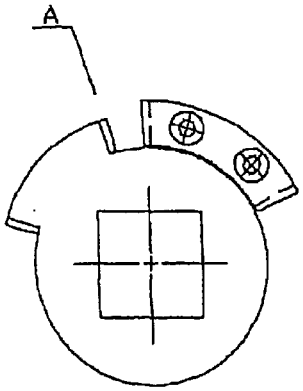
FIG. 3(B) is the X-plan view of FIG. 3(A).
Figure 3C:
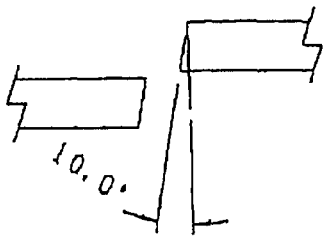
FIG. 3(C) is the A-plan view of FIG. 3(B).
Figure 4A:
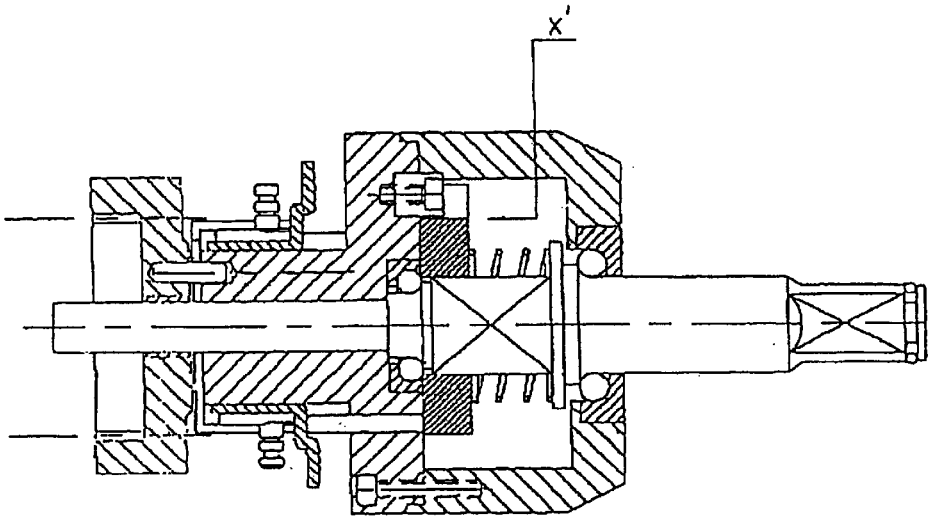
FIG. 4(A) is a cross-sectional view of the electric wrench of this invention when the hammer couples with the hammer block.
Figure 4B:
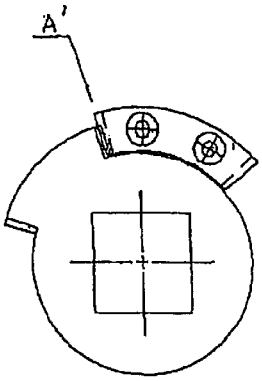
FIG. 4(B) is the X'-plan view of FIG. 4(A).
Figure 4C:
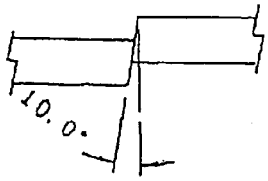
FIG. 4(C) is the A' plan view of FIG. 4(B).

As illustrated in FIG. 1 and FIG. 2, the electric wrench generally comprises a DC driving motor 01, transmission gears, a clutch, a power accumulator and a transmission shaft 17.

The DC driving motor 01 is connected to the power source at one end with power supply from a motor vehicle's battery and the other end of which is fixed onto a motor bracket 02 by at least one screw 03 with a slot on the motor bracket 02 above the center axis for placing one end of a transmission shaft 17 and the center of which is connected to a motor gear 05 through the motor bracket 02.

The transmission gears include a wheel gear 07 with a hole in the center for the transmission shaft 17 to go through and with the motor gear 05 inside it below the hole and the gear teeth of the motor gear 05 and the wheel gear 07 meshing with one another.

The clutch has a hole in the center for the transmission shaft 17 to go through and a clutch bracket 26 with at least one hole for fixing the clutch to the wheel gear 07 by a set pin 25 going through it and with two balancing weights 28 fixed onto two of its opposite sides by rivets 29, two small rotating shafts 30 which are parallel to the two balance weights 28 and fixed onto the clutch bracket 26 by screws, two coil springs 24 which are perpendicular to and connected to the two small rotating shafts 30 with friction reducing washers 31 in between, a controlling bracket 27 sliding along the inner surface of the clutch bracket 26, and a collar 32 for keeping the controlling bracket 27 in position inside the clutch bracket 26.

The power accumulator has a hallow in the center for the transmission shaft 17 to go through and a base block 10 and a cover block 15 fixing together by at least one screw 23 to form a hallow inside, and one end of the base block 10 is fixed inside the center of the clutch through the collar 32 and connected to the wheel gear 07 with the clutch bracket 26 in between by the one or more set pin 25, and the other end of the base block 10 facing the inner surface of the cover block 15 has at least two holes for allowing cylindrical pins 33 to move inside and a hammer 12 with an impact surface facing the inner surface of the cover block 15 above the center fixed by a screw 11.

The transmission shaft 17 is fixed onto the motor bracket 02 at one end with a fiction reducing bearing 04 surrounding it, and goes through the center of the wheel gear 07 with a fiction reducing bearing 06 surrounding it and being above and parallel to the axis of the motor gear 05, and further goes through the center of the clutch bracket 26 and then the center of the base block 10 with at least two ball bearings 09 and an outer ring 08 supporting it at the opening of the base block 10 facing the cover block 15 for fiction reduction, and forms a square block in the hallow formed by the base block 10 and the cover block 15 with a hammer block 13 on one of its side corresponding to the hammer 12 on the base block 10, and with at least two cylindrical pins 33 going through the holes of the base block 10 protruding with one end of the cylindrical pins 33 pressing against the collar 32 and the other end pressing against the side of the hammer block 13 facing the base block 10, and with a spring 22 surrounding the transmission shaft 17 in between the hammer block 13 and the opening of the cover block 15 with a cap 34 near the opening fixing the position of the spring 22, and with at least two ball bearings 20 and an outer ring 14 supporting it at the opening of the cover block 15 for fiction reduction, and the front part of the transmission shaft 17 protrudes from the opening of the cover block 15 with a washer 21 in between and a bearing 16 surrounding it for fiction reduction, and with a rubber washer 19 at the front end of the transmission shaft 17 for fitting onto a positioning tube 18 for adapting to drive a nut or bolt.

The hammer 12 and the hammer block 13 are each in the shape of a section of a ring being one-sixth of the ring and each corresponds to the other so as to generate the greatest output torque.

The impact surface between the hammer 12 and the hammer block 13 is at an oblique angle in the range of 5° to 15°, preferably at an oblique angle of 10°, to facilitate ease of engagement and disengagement.

When a user turns on the electric wrench by selecting either positive current or negative current, the DC driving motor 01 will rotate clockwise or anti-clockwise depending on whether it is positive current or negative current. When the DC driving motor 01 rotates, it will drive the motor gear 05 and thus drive the wheel gear 07 to rotate. The wheel gear 07 will accelerate and will drive the power accumulator to rotate with high speed. The power accumulator will drive the clutch to rotate. Not until the power accumulator reaches a pre-set high speed, the transmission shaft 17 with the hammer block 13 will not rotate. When the power accumulator reaches the pre-set high speed, it accumulates sufficient inertial force. Owing to centrifugal force, the collar 32 automatically moves towards the clutch bracket 26, thereby the spring 22 automatically moves the hammer block towards the direction of the clutch bracket 26. As a result, the hammer block 13 suddenly couples with the hammer 12 and drives the transmission shaft 17 to rotate suddenly. A high output torque is generated to loosen and tighten the bolts and nuts quickly and easily. As the impact of the hammer block 13 and the hammer 12 works in a state of centrifugation, there is no torque reaction or angular force while generating high output torque.

As to a further discussion of the manner of usage and operation of the present invention, the same should be apparent from the above description. Accordingly, no further discussion relating to the manner of usage and operation is provided.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

The present invention is capable of other embodiments and of being practiced and carried out in various ways. It is to be understood that the phraseology and terminology employed herein are for the purpose of description and should not be regarded as limiting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention.

What is claimed is:

1. An electric wrench for vehicle repairing comprising:

a DC driving motor, one end of which is connected to the power source with power supply from a motor vehicle's battery, the other end of which is fixed onto a motor bracket by at least one screw with a slot on the motor bracket above the center axis for placing one end of a transmission shaft, and the center of which is connected to a motor gear through the motor bracket;

transmission gears having a wheel gear with a hole in the center for the transmission shaft to go through and with the motor gear inside it below the hole and the gear teeth of the motor gear and the wheel gear meshing with one another;

a clutch having a hole in the center for the transmission shaft to go through and having a clutch bracket with at least one hole for fixing the clutch to the wheel gear by a set pin going through it and with two balancing weights fixed onto two of its opposite sides by rivets, two small rotating shafts which are parallel to the two balance weights and fixed onto the clutch bracket by screws, two coil springs which are perpendicular to and connected to the two small rotating shafts with friction reducing washers in between, a controlling bracket sliding along the inner surface of the clutch bracket, and a collar for keeping the controlling bracket in position inside the clutch bracket;

a power accumulator with a hollow in the center for the transmission shaft to go through and having a base block and a cover block fixed together by at least one screw to form a hollow inside, and one end of the base block being fixed inside the center of the clutch through the collar and connected to the wheel gear with the clutch bracket in between by the one or more set pin, and the other end of the base block facing the inner surface of the cover block having at least two holes for allowing cylindrical pins to move inside and a hammer with an impact surface facing the inner surface of the cover block above the center fixed by a screw; and a transmission shaft with one end of which fixed onto the motor bracket with a fiction reducing bearing surrounding it, and going through the center of the wheel gear with a fiction reducing bearing surrounding it and being above and parallel to the axis of the motor gear, and further going through the center of the clutch bracket and then the center of the base block with at least two ball bearings and an outer ring supporting it at the opening of the base block facing the cover block for fiction reduction, and forming a square block in the hollow formed by the base block and the cover block with a hammer block on one of its side corresponding to the hammer on the base block, and with at least two cylindrical pins going through the holes of the base block protruding with one end of the cylindrical pins pressing against the collar and the other end pressing against the side of the hammer block facing the base block, and with a spring surrounding the transmission shaft in between the hammer block and the opening of the cover block with a cap near the opening fixing the position of the spring, and with at least two ball bearings and an outer ring supporting it at the opening of the cover block for fiction reduction, and the front part of the transmission shaft protruding from the opening of the cover block with a washer in between and a bearing surrounding it for fiction reduction, and with a rubber washer at the front end of the transmission shaft for fitting onto a positioning tube for adapting to drive a nut or bolt.

2. The electric wrench for vehicle repairing according to claim 1, wherein the hammer and the hammer block are each in the shape of a section of a ring being one-sixth of the ring and each corresponds to the other so as to generate the greatest output torque.

3. The electric wrench for vehicle repairing according to claim 1, wherein the impact surface between the hammer and the hammer block is at an oblique angle in the range of 5° to 15° to facilitate ease of engagement and disengagement.

4. The electric wrench for vehicle repairing according to claim 1, wherein the impact surface between the hammer and the hammer block is at an oblique angle of 10° to facilitate ease of engagement and disengagement.

* * * * *